US011964836B2

(12) United States Patent
Lee

(10) Patent No.: US 11,964,836 B2
(45) Date of Patent: Apr. 23, 2024

(54) MOUNTING STRUCTURE OF CASSETTE WITH PROTRUDED SUPPORTER TO MAIN BODY

(71) Applicant: Hewlett-Packard Development Company, L.P., Spring, TX (US)

(72) Inventor: Hoil Lee, Seongnam-si (KR)

(73) Assignee: Hewlett-Packard Development Company, L.P., Spring, TX (US)

( * ) Notice: Subject to any disclaimer, the term of this patent is extended or adjusted under 35 U.S.C. 154(b) by 248 days.

(21) Appl. No.: 17/609,827

(22) PCT Filed: Oct. 7, 2020

(86) PCT No.: PCT/US2020/054602
§ 371 (c)(1),
(2) Date: Nov. 9, 2021

(87) PCT Pub. No.: WO2021/071963
PCT Pub. Date: Apr. 15, 2021

(65) Prior Publication Data

US 2022/0219924 A1 Jul. 14, 2022

(30) Foreign Application Priority Data

Oct. 10, 2019 (KR) ..... 10-2019-0125160

(51) Int. Cl.
*B65H 1/04* (2006.01)
*B65H 1/26* (2006.01)

(52) U.S. Cl.
CPC ..... *B65H 1/266* (2013.01); *B65H 1/04* (2013.01); *B65H 2405/1117* (2013.01); *B65H 2405/1122* (2013.01); *B65H 2405/114* (2013.01)

(58) Field of Classification Search
CPC .... B65H 2405/1122; B65H 2405/2405; B65H 2405/31; B65H 2405/321; B65H 2405/1144; B65H 2405/11164
See application file for complete search history.

(56) References Cited

U.S. PATENT DOCUMENTS

| | | | | |
|---|---|---|---|---|
| 9,567,172 | B2 * | 2/2017 | Chiba | B65H 1/12 |
| 9,701,497 | B2 * | 7/2017 | Washino | B65H 1/266 |
| 10,053,310 | B2 * | 8/2018 | Nishiyama | B65H 1/04 |
| 11,465,870 | B2 * | 10/2022 | Latsko | B65H 5/36 |

(Continued)

FOREIGN PATENT DOCUMENTS

| | | |
|---|---|---|
| JP | H5-46837 U | 6/1993 |
| JP | H5-147750 A | 6/1993 |

(Continued)

*Primary Examiner* — Howard J Sanders
(74) *Attorney, Agent, or Firm* — Brooks Cameron & Huebsch, PLLC

(57) ABSTRACT

The image forming apparatus may include a main body and a cassette to enter or exit the main body along a first direction to be mounted in or released from the main body, respectively. The cassette may include a supporter extendable in a second direction perpendicular to the first direction to protrude from an exterior of the main body. The main body may include a lever which is movable in the first direction between a supporting position at which the lever supports the main body and a release position at which to allow the cassette to enter or exit the main body along the first direction.

15 Claims, 9 Drawing Sheets

(56) References Cited

U.S. PATENT DOCUMENTS

| | | | | |
|---|---|---|---|---|
| 2012/0301203 | A1 | 11/2012 | Ueno et al. | |
| 2023/0051596 | A1* | 2/2023 | Dandurand | B65H 1/266 |
| 2023/0174335 | A1* | 6/2023 | Tateishi | B65H 1/04<br>271/314 |

FOREIGN PATENT DOCUMENTS

| | | | | |
|---|---|---|---|---|
| JP | H7-48041 | A | | 2/1995 |
| JP | H8-188267 | A | | 7/1996 |
| JP | 2005-247441 | A | | 9/2005 |
| JP | 2006193311 | A | * | 7/2006 |
| JP | 2009-169050 | A | | 7/2009 |
| JP | 2018-52730 | A | | 4/2018 |
| KR | 1994-0011864 | B1 | | 12/1994 |

* cited by examiner

MOUNTING STRUCTURE OF CASSETTE WITH PROTRUDED SUPPORTER TO MAIN BODY

BACKGROUND

The image forming apparatus is an apparatus for generating, printing, receiving, or transmitting image data. Examples of the image forming apparatus include a printer, a scanner, a copy machine, a fax machine, and a multifunction printer integrating these functions. The image forming apparatus includes a main body for generating image data and printing the generated image data on a printable media, and at least one cassette configured to supply the printable media to the main body.

In general, a size of the image forming apparatus depends on a maximum size of the available printable media. For example, if the image forming apparatus is capable of printing on A4 printable media, the size of the image forming apparatus is larger than the A4 printable media. In addition, if the image forming apparatus is capable of printing on both A3 printable media and A4 printable media, the size of the image forming apparatus is larger than A3 printable media.

BRIEF DESCRIPTION OF THE DRAWINGS

The examples described herein may be better understood by referring to the following description in conjunction with the accompanying drawings in which reference numerals denote structural or functional elements, of which.

It should be understood that the above-referenced drawings are not necessarily to scale, presenting a somewhat simplified representation of various preferred features illustrative of the basic principles of the disclosure. The specific design features of the present disclosure, including, for example, specific dimensions, orientations, locations, and shapes, will be determined in part by the particular intended application and use environment.

DETAILED DESCRIPTION OF EXAMPLES

The terminology used herein is for the purpose of describing particular examples only and is not intended to be limiting of the present disclosure. As used herein, the singular forms "a," "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. The term "coupled" denotes a physical relationship between two components whereby the components are either directly connected to one another or indirectly connected via one or more intermediary components.

Hereinafter, examples of the present disclosure will be described in detail with reference to the accompanying drawings.

Figure 1:
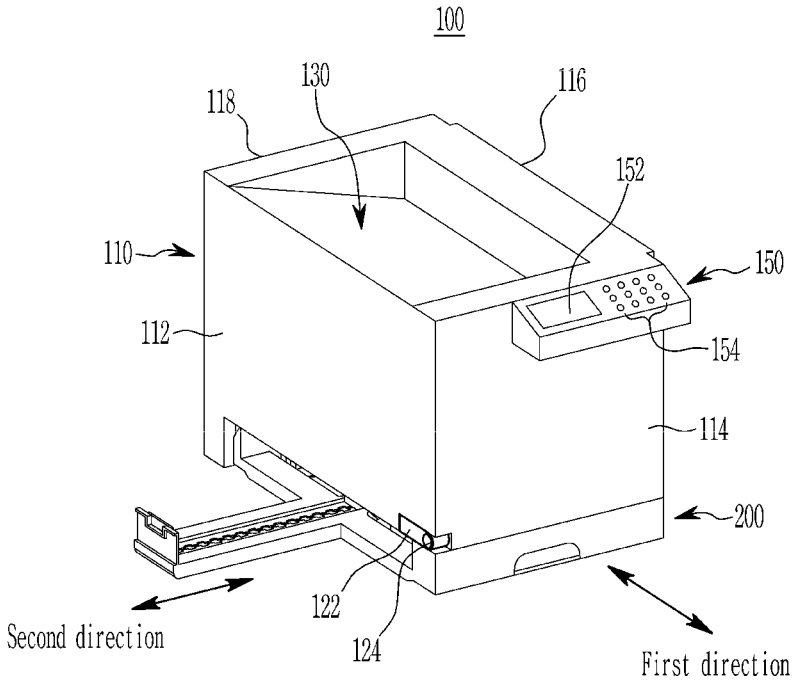
FIG. 1 is a schematic diagram illustrating a state where a cassette is mounted to a main body in an image forming apparatus according to an example of the present disclosure.
Figure 2:
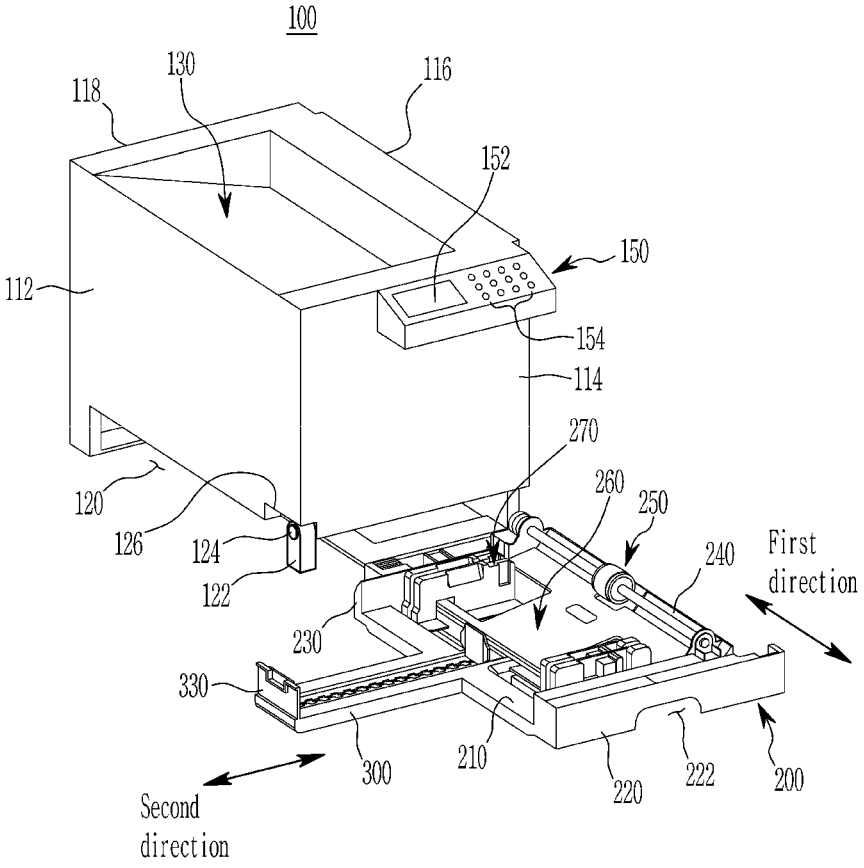
FIG. 2 is a schematic diagram illustrating a state in which a cassette is separated from a main body in an image forming apparatus according to an example of the present disclosure.

FIG. 1 is a schematic diagram illustrating a state where a cassette is mounted to a main body in an image forming apparatus according to an example of the present disclosure; and FIG. 2 is a schematic diagram illustrating a state in which a cassette is separated from a main body in an image forming apparatus according to an example of the present disclosure.

As shown in FIG. 1 and FIG. 2, an image forming apparatus 100 according to an example of the present disclosure includes a main body 110 and a cassette 200. In one example, the image forming apparatus 100 may be an image forming apparatus of front in side out (FISO) type. In the image forming apparatus of FISO type, the cassette 200 moves along a first direction and is mounted in the main body 110, and a printable media moves along a second direction perpendicular to the first direction and is supplied to the main body 110.

The main body 110 may have a rectangular pillar shape having a space formed therein, but a shape of the main body 110 is not limited to the rectangular pillar shape. The main body 110 may include first, second, third, and fourth side surfaces 112, 114, 116, and 118 as side surfaces thereof. The first and third side surfaces 112 and 116, and the second and fourth side surfaces 114 and 118 face each other, respectively, and the first, second, third, and fourth side surfaces 112, 114, 116 and 118 are disposed sequentially in a counterclockwise direction. One side surface meets two adjacent side surfaces to form two corners. The first side surface 112 and the third side surface 116 are disposed on one side and on other side in the second direction to be perpendicular to the second direction, respectively, and the second side surface 114 and the fourth side surface 118 are disposed on a front side and a rear sides in the first direction to be perpendicular to the first direction, respectively.

In this specification, the "first direction" means a direction parallel to a direction in which the cassette 200 moves to be mounted in the main body 110. In this specification, a front end, a front side, a front surface, or similar terms in the "first direction" refer to an end, a side, a surface, etc. opposite to a side to which the cassette 200 moves to be mounted in the main body 110, and a rear end, a rear side, a rear surface, or similar terms in the "first direction" refer to an end, a side, a surface, etc. close to the side to which the cassette 200 moves to be mounted in the main body 110.

In this specification, the "second direction" means a direction parallel to a direction in which the printable media moves in the cassette 200 to be supplied to the main body 110. The "second direction" is perpendicular to the "first direction". In this specification, one end, one side, one surface, or similar terms in the "second direction" refers to an end, a side, a surface, etc. opposite to a side to which the printable media moves in the cassette 200, and the other end, the other side, the other surface, or similar terms in the "second direction" refers to an end, a side, a surface, etc. close to the side to which the printable media moves in the cassette 200.

An upper surface of the main body 110 is provided with a printable media output box 130, and the printable media on which an image is formed by the main body 110 comes out to the printable media output box 130.

A manipulation unit 150 is provided at a predetermined position of the main body 110 (in this example, an upper portion of the second side surface 114). The manipulation unit 150 includes a display unit 152 and a button/indication unit 154.

The display unit 152 may display a current status of the image forming apparatus 100, and a screen demanding a user's response may be displayed on the display unit 152 during operation. In addition, a user may set a menu through the display unit 152.

The button/indication unit 154 may include at least one of a status LED, an operation status button, a counter button, an eco button, a delete button, a number button, a return button, a redial/pose button, a login/logout button, an on hook dial button, a power button, and an urgent copy button, a stop button, and a start button.

The status LED may display the current status of the image forming apparatus 100 by changing color and flickering, and the operation status button serves to display currently performing tasks, pending tasks, completed tasks, error codes or security tasks in the image forming apparatus 100 on the display unit in response to user manipulation. In response to user manipulation, the counter button serves to display the accumulated number of the printable media which have been used in the image forming apparatus 100 until the present time, and the eco button serves to forcibly perform a power saving mode (eco mode) of the image forming apparatus for energy saving. The delete button, in response to user manipulation, serves to delete characters, numbers and symbols in an editing area, and the number button allows a user to enter phone or fax number or to input other numbers and letters. In response to user manipulation, the return button serves to initialize the current settings of the image forming apparatus 100, and the redial/pose button serves to redial the most recently dialed fax number or received fax number in a standby mode or insert a pause (-) into fax number in an edit mode. In response to user manipulation, the login/logout button serves to allow a user to log in to the image forming apparatus 100 or to log out from the image forming apparatus 100, and the on hook dial button serves to make a dial tone sound from a speaker. The power button allows a user to turn the image forming apparatus 100 on or off, and when a user presses the urgent copy button, other tasks in progress may be stopped for urgent copy. In response to user manipulation, the stop button serves to stop the currently performing task in the image forming apparatus 100, and the start button serves to start the currently set task.

The main body 110 is formed with a cassette groove 120 having a shape corresponding to the cassette 200. The cassette groove 120 may be formed at a lower part of the main body 110, but is not limited thereto. The cassette 200 can be mounted in the cassette groove 120 to supply the printable media 24 loaded in the cassette 200 to the main body 110. The cassette groove 120 includes a part of the first side surface 112 and a part of the second side surface 114 of the main body 110. In further detail, the cassette groove 120 includes a corner at which the first side surface 112 and the second side surface 114 are joined, and has a square pillar shape (the shape of the cassette groove 120 is not limited to the square pillar shape) formed by extending the part of the first side surface 112 to the other side in the second direction by a predetermined length and by extending the part of the second side surface 114 to the rear side in the first direction by a predetermined length. Thus, the third side surface 116 and the fourth side surface 118 of the main body 110 can directly support the main body 110 with respect to the ground, but the parts of the first side surface 112 and the second side surface 114 included in the cassette groove 120 cannot support the main body 110 directly. A guide rail (not shown) may be formed on the inner surface of the third side surface 116 facing the cassette groove 120. The guide rail may be formed along the first direction to set a moving direction and a mounting position of the cassette 200 in the cassette groove 120.

A lever 122 that is moveable along the first direction, for example, as a pivot lever 122 pivotable along the first direction (i.e., pivotable about the second direction) is equipped on a lower surface of the main body 110 corresponding to the cassette groove 120. The pivot lever 122 is movable at least between a supporting position at which the pivot lever 122 can support the main body 110 and a release position at which the pivot lever 122 allows for entry of the cassette 200. The pivot lever 122 is rotated by the cassette 200 when the cassette 200 is mounted in the cassette groove 120 so as not to hinder the cassette 200 from being mounted in the cassette groove 120. In one example, the pivot lever 122 is pivotally mounted to the main body 110 via a pivot pin 124, but is not limited thereto. That is, any mounting method for allowing the pivot lever 122 to pivot to the first direction by the cassette 200 may be applied.

When the cassette 200 is mounted in the cassette groove 120, the pivot lever 122 rotates toward the rear side in the first direction by the cassette 200, and when the cassette 200 is separated from the cassette groove 120, the pivot lever 122 rotates toward the front side in the first direction by the cassette 200. When the cassette 200 is completely separated from the cassette groove 120, the pivot lever 122 is positioned vertically by its own weight.

The pivot lever 122 is located on a path where the cassette 200 passes when the cassette 200 is mounted in the cassette groove 120. In one example, the pivot lever 122 may be located at an entrance of the main body 110 through which the cassette 200 enters the main body 110. In another example, the pivot lever 122 may be located at a corner portion where the first side surface 112 and the second side surface 114 are joined, but a position of the pivot lever 122 is not limited thereto. When the pivot lever 122 is positioned at the corner where the first side surface 112 and the second side surface 114 are joined, the main body 110 can be stably supported against the ground by the pivot lever 122 together with the lower end portions of the third and fourth side surfaces 116 and 118.

The lower surface of the main body 110 corresponding to the cassette groove 120 may be formed with a lever groove 126 to accommodate the pivot lever 122, but formation of the lever groove 126 is not limited thereto. When the cassette 200 is mounted in the cassette groove 120, the pivot lever 122 may rotate toward the rear side in the first direction and be accommodated in the lever groove 126. In this example, an upper surface of the cassette 200 is adapted to support the main body 110 through the pivot lever 122. In further detail, the pivot lever 122 is interposed between the lower surface of the main body 110 corresponding to the cassette groove 120 and the upper surface of the cassette 200 in a state that the cassette 200 is mounted in the cassette groove 120. In addition, the pivot lever 122 is in contact with the lower surface of the main body 110 and the upper surface of the cassette 200. In this state, the lower surface of the cassette 200 may be located on the same plane as the other lower surface of the main body 110, which is not included in the cassette groove 120. Accordingly, while the cassette 200 is mounted in the cassette groove 120, the lower surface of the cassette 200 may support the image forming apparatus 100 against the ground along with the other lower surface of the main body 110.

The shape of the pivot lever 122 may be a rectangular bar shape, but is not limited thereto. In order to facilitate the rotation of the pivot lever 122, a lower end of the pivot lever 122 may be positioned higher than the other lower surface of the main body 110, which is not included in the cassette groove 120 by a predetermined height (G) (see FIG. 5). Accordingly, when the cassette 200 is mounted in the cassette groove 120 while the image forming apparatus 100 is positioned on the ground, the lower end of the pivot lever 122 may rotate without interference with an inner bottom surface of the cassette 200.

Figure 3:
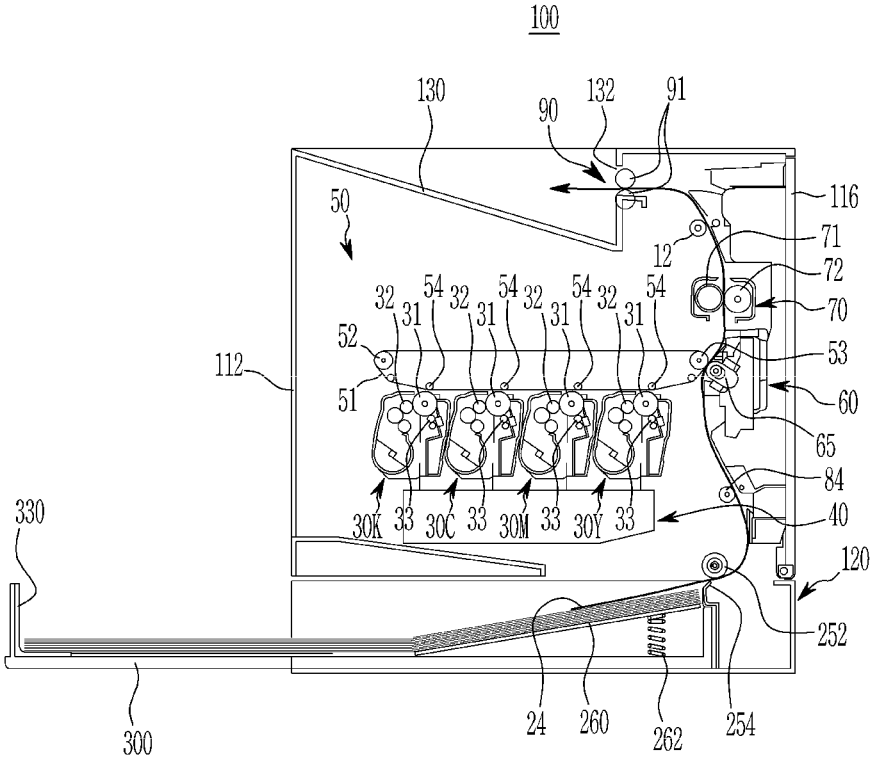
FIG. 3 illustrates an internal structure of an image forming apparatus according to an example of the present disclosure.

FIG. 3 illustrates an internal structure of an image forming apparatus according to an example of the present disclosure. The image forming apparatus 100 according to an example of the present disclosure includes therein a plurality of developing units 30C, 30M, 30Y, and 30K to develop an electrostatic latent image into a visible image through a developer (e.g., a toner), an exposure unit 40 to form the electrostatic latent image on a photosensitive body 31 of each charged developing unit 30C, 30M, 30Y or 30K, a transfer device 50 and 60 to receive the printable media 24 from the cassette 200 and transfer the visible image formed on the photosensitive body 31 to the printable media 24, and a fixing unit 70 to fix the developer transferred to the printable media 24. In addition, a discharge port 132 for discharging the printable media 24 on which the image forming is completed is provided at a side of the printable media output box 130.

Each of the developing units 30C, 30M, 30Y, 30K includes the photosensitive body 31 having a charged surface on which the latent electrostatic image is formed by the exposure unit 40, a developing roller 32 for supplying the developer to the photosensitive body 31, and a charging roller 33 for charging the surface of the photosensitive body 31.

In one example, the developing units 30C, 30M, 30Y, and 30K is comprised of four developing units 30C, 30M, 30Y, and 30K which store different colors of developers, for example, cyan C, magenta M, yellow Y and black K, respectively, to develop the images of cyan C, magenta M, yellow Y, and black K. The four developing units 30C, 30M, 30Y and 30K are arranged in parallel with one another beneath the transfer device 50 and 60.

The exposure unit 40 irradiates light including image information to the photosensitive media 31 provided at each developing unit 30C, 30M, 30Y, or 30K to form the electrostatic latent image on the surface of each photosensitive body 31.

The transfer devices 50 and 60 includes a first transfer unit 50 to which the visible image formed by the developer is transferred from the developing units 30C, 30M, 30Y, and 30K, and a second transfer unit 60 to transfer the visible image on the first transfer unit 50 to the printable media 24. The second transfer unit 60 includes a transfer roller 65.

The first transfer unit 50 includes a transfer belt 51 that is an intermediate transfer body to which the developer developed on the photosensitive bodies 31 of the developing units 30C, 30M, 30Y, and 30K in the form of a visible image is transferred in an overlapping manner, a driving roller 52 and a driven roller 53, each disposed at both sides of the transfer belt 51 to rotate the transfer belt 51, and a plurality of rollers 54 disposed opposite to the photosensitive bodies 31 of the developing units 30C, 30M, 30Y, and 30K with the transfer belt 51 interposed therebetween to transfer the visible image formed on the photosensitive bodies 31 to the transfer belt 51. The rollers 54, the drive roller 52, and the driven roller 53 are rotatably mounted on a transfer belt frame (not shown).

The fixing unit 70 includes a heating roller 71 for generating heat, and a pressure roller 72 having a peripheral surface that is made of an elastically deformable material to press the printable media 24 against a peripheral surface of the heating roller 71.

In addition, the main body 110 is provided therein with a feed roller 84 for guiding the printable media 24 supplied from the cassette 200 upwardly, a conveying roller 12 disposed above the fixing unit 70 and guiding the printable media 24 passing through the fixing unit 70 toward the discharge port 132, and a discharge unit 90 arranged adjacent to the discharge port 132 and discharging the printable media 24 through the discharge port 132. The discharge unit 90 includes a pair of discharge rollers 91 disposed inside the discharge port 132.

The feed roller 84 is configured to receive a front end of the printable media 24 from the cassette 200 and to feed the printable media 24 to an image forming unit (e.g., the transfer devices 50 and 60).

Figure 4:
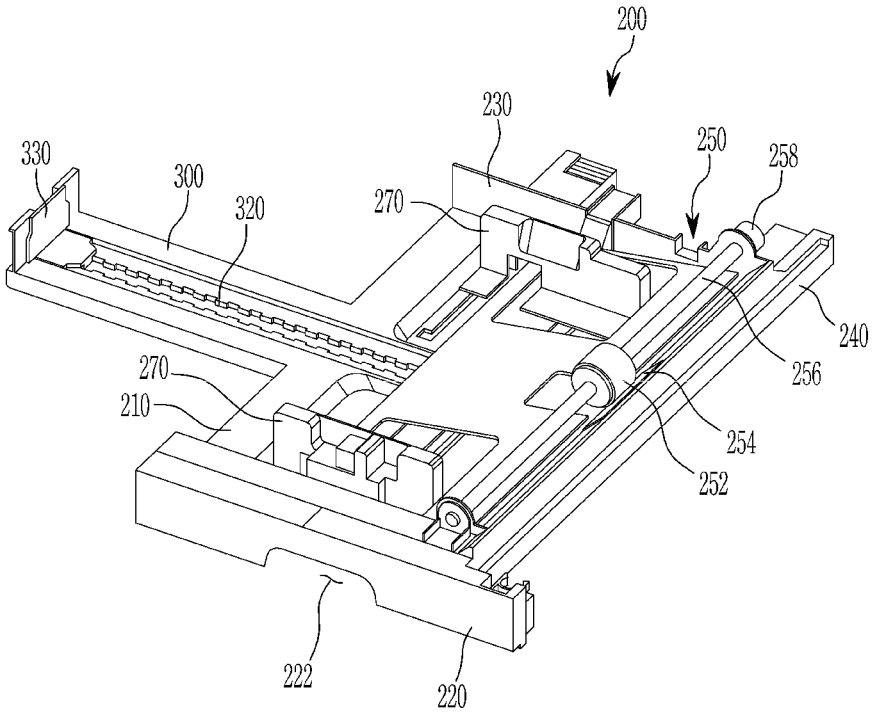
FIG. 4 is a perspective view illustrating a cassette according to one example.

FIG. 4 is a perspective view illustrating a cassette according to one example. As shown in FIG. 4, the cassette 200 according to one example includes a lower frame 210 and first, second, and third frames 220, 230, and 240 protruded upwardly from an edge of the lower frame 210. A shape of the cassette 220 corresponds to a shape of the cassette groove 120 as a whole. The first, second, and third frames 220, 230, and 240 are protruded upwardly from the lower frame 210 to form a space for loading the printable media 24 between the first and second frames 220 and 230.

The lower frame 210 has a rectangular plate shape corresponding to the shape of the cassette groove 120, and a knock-up plate 260 and an elastic member 262 are disposed on the lower frame 210 to support a bottom surface of the printable media 24. In detail, the printable media 24 are loaded on the knock-up plate 260, and the elastic member 262 elastically supports the knock-up plate 260.

In addition, a pair of printable media guiders 270 is movably mounted on the lower frame 210. The pair of printable media guiders 270 guides both sides of the printable media 24 with respect to the second direction so that the printable media 24 can move along the second direction while maintaining a constant posture. At least one of the pair of printable media guiders 270 is movably mounted along the first direction on the lower frame 210 to set a distance between the pair of printable media guiders 270 to correspond to the size of printable media 24 loaded in the cassette 200.

The first frame 220 protrudes upwardly from the front side of the lower frame 210 in the first direction. A handle 222 is formed in the first frame 220 to facilitate a user to grasp the handle 222 to mount the cassette 200 in the cassette groove 120 or to separate the cassette 220 from the cassette groove 120.

The second frame 230 protrudes upwardly from the rear side of the lower frame 210 in the first direction. The first and second frames 220 and 230 may be formed by a predetermined length along the second direction.

The third frame 240 protrudes upwardly from the other side of the lower frame 210 in the second direction. The third frame 240 may be formed along the first direction between the first and second frames 220 and 230. A guider (not shown) corresponding to the guide rail may be mounted on an outer surface of the third frame 240 corresponding to the inner surface of the third side surface 116 of the main body 110. The guide rail and the guider allow the cassette 200 to be mounted in the cassette groove 120. In another example, the guider may be formed on the inner surface of the third side surface 116 and the guide rail may be formed on the outer surface of the third frame 240. In addition, means for guiding the cassette 200 to be mounted in the cassette groove 120 is not limited to the guide rail and the guider.

A pick-up unit 250 may be mounted at the third frame 240. The pick-up unit 250 includes a pick-up roller 252, a friction pad 254, a shaft 256, and a gear 258.

One end of the shaft 256 is equipped with the gear 258, which is connected with a power source (not shown) and is powered. The shaft 256 is also equipped with the pick-up roller 252. The gear 258, the shaft 256 and the pick-up roller 252 can rotate together. In further detail, when the gear 258 receives power from the power source, the shaft 256 and the pick-up roller 252 fixedly mounted on the shaft 256 rotate.

The pick-up roller 252 is configured to contact the printable media 24 loaded on the knock-up plate 260. An external circumference of the pick-up roller 252 is made of a material with high friction coefficient so that the printable media 24 can be picked up one by one by applying friction force to the printable media 24 while the pick-up roller 252 rotates.

The friction pad 254 is mounted opposite to the pick-up roller 252. The friction pad 254 causes the pick-up roller 252 to move the printable media 24 one by one by generating friction force greater than the friction force between the printable media 24.

There is no frame protruding upwardly at a side of the lower frame 210 facing the third frame 240. That is, the one side of the cassette 200 in the second direction is opened. In addition, the lower frame 210 includes a supporter 300 extending to the one side in the second direction. An upper surface of the supporter 300 may be coplanar with an upper surface of the lower frame 210 to support the bottom of the printable media 24. One end 330 of the supporter 300 in the second direction is bent upwardly. In one example, a rail 320 is formed along the second direction on the supporter 300, and a slider 310 may be mounted on the rail 320 to be movable along the second direction. The slider 310 can be moved on the rail 320 to meet the size of the printable media 24 loaded in the cassette 200 and push the printable media 24 toward the pick-up unit 250 to facilitate a pick-up operation of the pick-up unit 250. In addition, the slider 310 prevents the printable media 24 from leaving the cassette 200 due to vibrations or the like occurring during the image forming operation.

Figure 9:
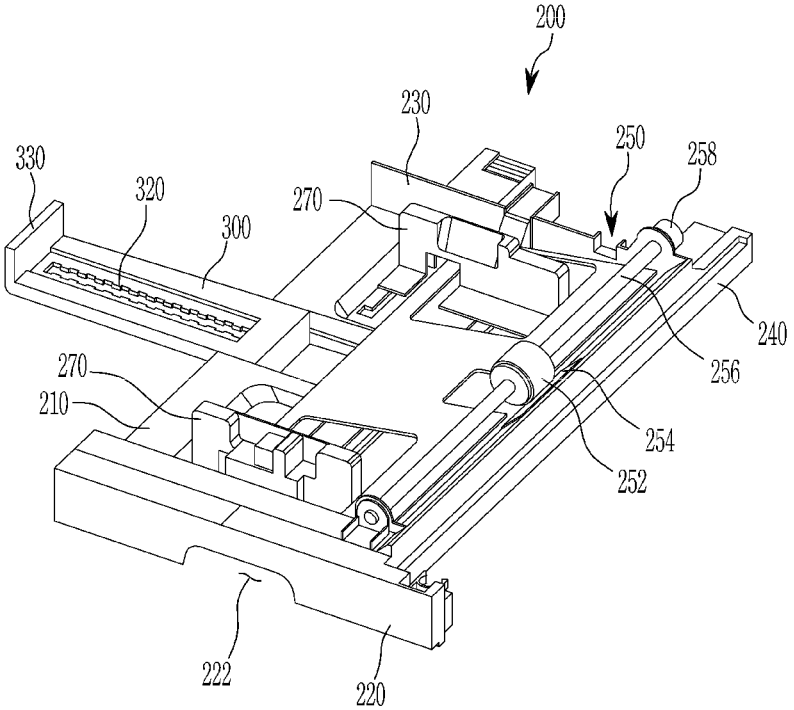
FIG. 9 is a perspective view illustrating a cassette according to another example.

According to another example of the present disclosure, as shown in FIG. 9, the supporter 300 itself may be movable along the second direction relatively to the cassette 200. In further detail, a groove may be formed in the lower frame 210 along the second direction, and the supporter 300 may be mounted in the groove through guide means. In this example, the one end 330 of the supporter 300 plays a role of pushing the printable media loaded in the cassette 200 toward the pick-up unit 250.

Since the one side of the cassette 200 in the second direction is opened and the supporter 300 extending in the second direction is formed at the lower frame 210, the printable media 24 larger than a size of the lower frame 210 can be loaded in the cassette 200. For example, if the lower frame 210 is provided which can load an A4 printable media such that a long side of the A4 printable media is aligned with the first direction, the cassette 200 can load an A3 printable media through the supporter 300 extending to the one side in the second direction such that a long side of the A3 printable media is aligned with the second direction (see FIG. 3). Typically, a cross-section of the main body 110 in a vertical direction is slightly larger than a cross-section of the cassette groove 120 in the vertical direction, and the cross-section of the cassette groove 120 in the vertical direction corresponds to a cross-section of the cassette 200 in the vertical direction. Accordingly, an image can be formed on the A3 printable media by using the image forming apparatus capable of forming an image on the A4 printable media, thereby significantly reducing a size of the image forming apparatus supporting the A3 printable media.

In addition, when the cassette 200 including the supporter 300 is mounted in the cassette groove 120, the pivot lever 122 rotatable in the first direction is positioned on the path through which the cassette 200 passes (e.g., an entrance through which the cassette 200 enters the cassette groove 120). The pivot lever 122 is positioned on a path through which the first frame 220 and the second frame 230 pass, and may be rotated in the first direction by the first frame 220 or the second frame 230. Accordingly, the pivot lever 122 supports the lower part of the main body 110 in which the cassette groove 120 is formed, and does not hinder the cassette 200 from being mounted in the cassette groove 120.

Figure 5:
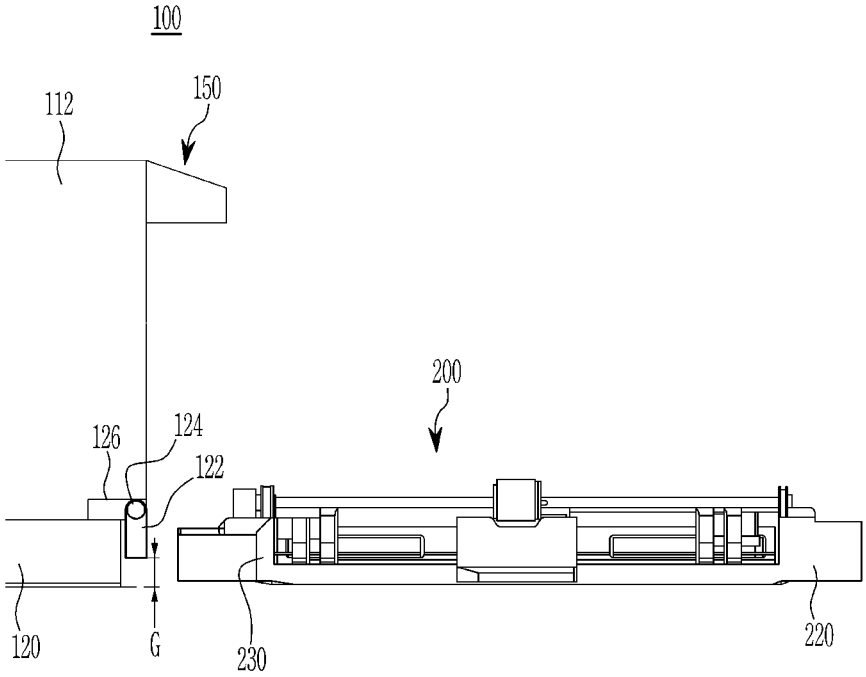
FIG. 5 to FIG. 7 illustrate processes of mounting a cassette to an image forming apparatus according to one example of the present disclosure.
Figure 6:
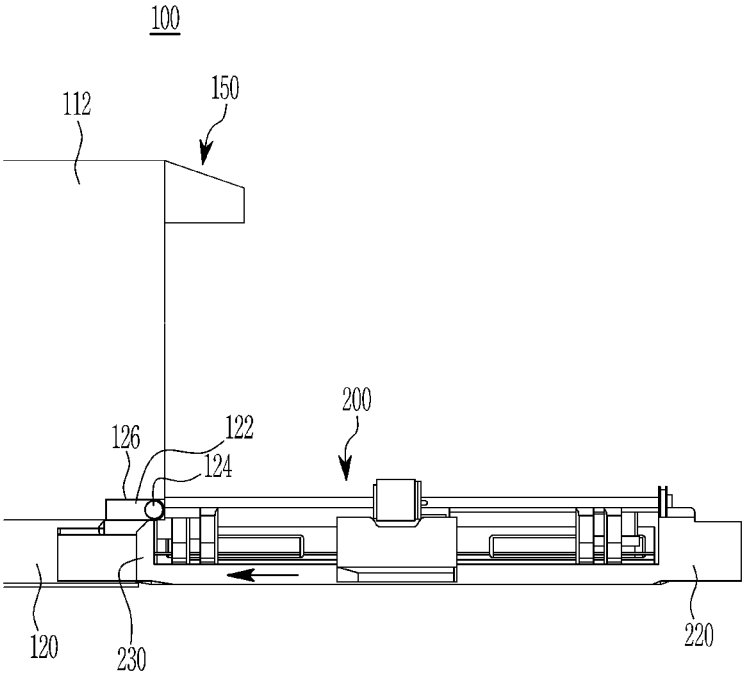
Figure 7:
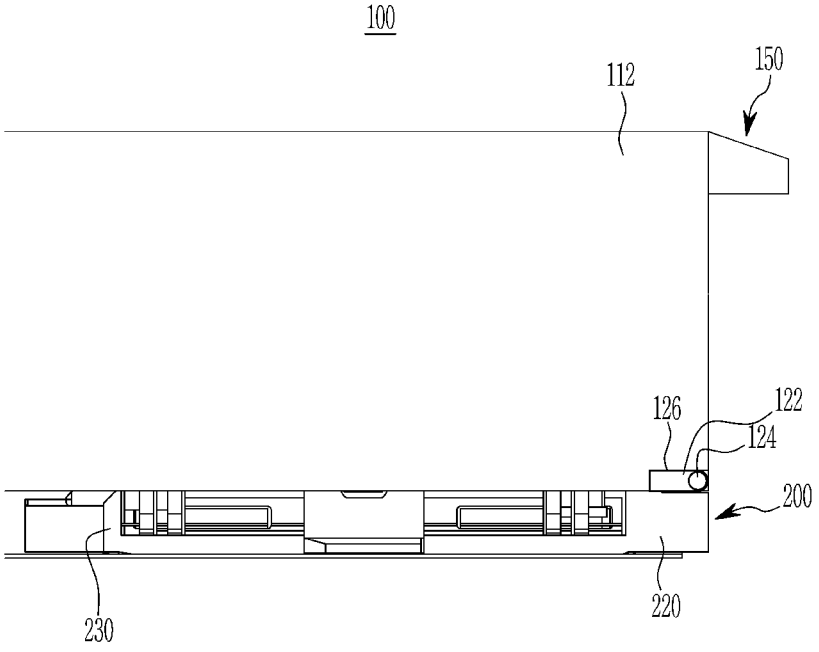
Figure 8:
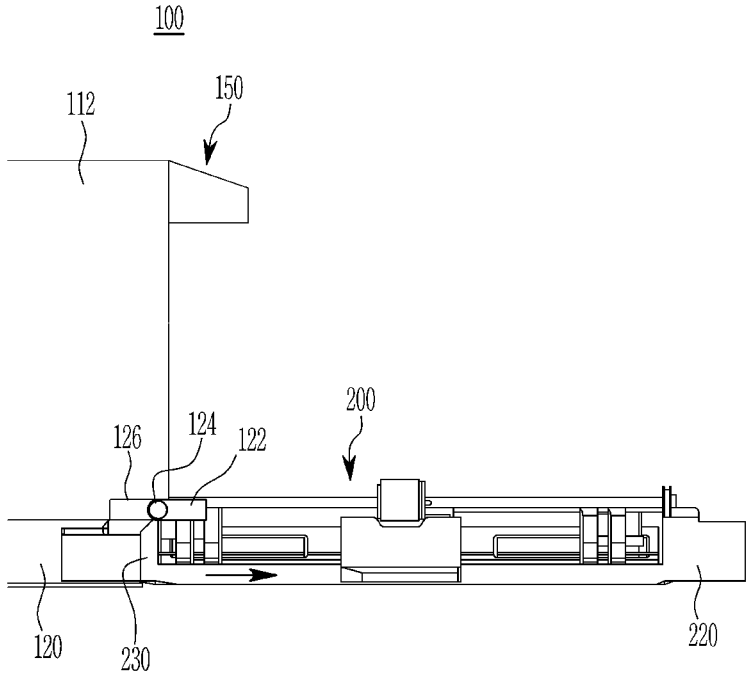
FIG. 8 illustrates a process of separating a cassette from an image forming apparatus according to one example of the present disclosure.

FIG. 5 to FIG. 7 illustrate processes of mounting a cassette to an image forming apparatus according to one example of the present disclosure; and FIG. 8 illustrates a process of separating a cassette from an image forming apparatus according to one example of the present disclosure.

As shown in FIG. 5, the printable media is loaded into the cassette 200 when the cassette 200 is separated from the main body 110. For example, the A4 printable media may be placed in the cassette 200 such that the long side of the A4 printable media is aligned with the first direction, and the A3 printable media may be placed in the cassette 200 such that the long side of the A3 printable media is aligned with the second direction. After that, the slider 310 is moved on the rail 320 or the supporter 300 itself is moved to push the printable media 24 towards the pick-up unit 250 according to the size of the printable media loaded in the cassette 200. At this time, the pivot lever 122 is positioned vertically by its own weight. That is, the pivot lever 122 is positioned at the release position to allow the cassette 200 to enter.

As shown in FIG. 6, when the cassette 200 begins to enter the cassette groove 120, the second frame 230 rotates the pivot lever 122 to the rear side in the first direction. Accordingly, the pivot lever 122 is seated in the lever groove 126.

As shown in FIG. 7, when the cassette 200 is fully seated in the cassette groove 120, the first frame 220 of the cassette 200 rotates the pivot lever 122 to the rear side in the first direction and seats the pivot lever 122 in the lever groove 126. In other words, the pivot lever 122 is positioned in a supporting position to support the main body 110. The first frame 220 together with the pivot lever 122 supports the main body 110 against the ground.

When the cassette 200 begins to be separated from the cassette groove 120, the first frame 220 is released from the cassette groove 120. In this case, the pivot lever 122 is positioned vertically by its own weight between the first and second frames 220 and 230. That is, the pivot lever 122 may be positioned at the release position.

As shown in FIG. 8, when the cassette 200 is further pulled out of the cassette groove 120, the second frame 230 rotates the pivot lever 122 to the front side in the first direction. Accordingly, the pivot lever 122 does not hinder the cassette 200 from being separated from the cassette groove 120. When the cassette 200 is completely out of the cassette groove 120, as shown in FIG. 5, the pivot lever 122 is positioned vertically by its own weight. That is, the pivot lever 122 returns to the release position.

Further examples of the present disclosure are described below.

An image forming apparatus according to further examples of the present disclosure may include a main body for the image forming apparatus and a cassette inserting into the main body in a first direction to be mounted in the main body and enabling of supplying a printable media to the main body. The cassette may include a supporter extending in a second direction perpendicular to the first direction and protruding to an exterior of the main body. The image forming apparatus may further include a pivot lever which is movable between a supporting position at which the pivot lever supports the main body and a release position at which the pivot lever allows for entry of the cassette.

According to further examples of the present disclosure, the cassette may be mounted in or released from the main body by moving in the first direction, and the printable media may be supplied to the main body along the second direction.

According to further examples of the present disclosure, a lower part of the main body may be formed with a cassette groove in which the cassette is mounted, the cassette groove may include respective parts of two side surfaces of the main body joining at one corner, and the pivot lever may be positioned at the one corner.

According to further examples of the present disclosure, the cassette may include a lower frame on which the printable media is positioned, and first and second frames, each being formed at a front side and a rear side in the first direction on the lower frame so that the printable media is loaded between the first and second frames. The pivot lever may be rotated by the first frame or the second frame when the cassette enters or exits from the main body along the first direction.

According to further examples of the present disclosure, one side surface of the cassette in the second direction between the first and second frames may be open, and the supporter may extend from the lower frame toward one side in the second direction more than the main body.

According to further examples of the present disclosure, a pick-up unit is mounted at an opposite side surface to the one side surface of the cassette that is open, the pick-up unit picking-up and supplying to the main body the printable media loaded in the cassette.

According to further examples of the present disclosure, the first frame may support the one corner through the pivot lever.

According to further examples of the present disclosure, a rail may be formed on the supporter along the second direction, and a slider may be movably mounted on the rail along the second direction.

According to further examples of the present disclosure, the supporter may be movable relatively to the cassette along the second direction.

According to further examples of the present disclosure, an image forming apparatus may include a main body for the image forming apparatus, and a cassette inserting into the main body in a first direction to be mounted in the main body, enabling of supplying a printable media to the main body in a mounted state, and having a supporter protruding to an exterior of the main body in a second direction perpendicular to the first direction. A pivot lever enabling of rotating to the first direction may be provided at an entrance of the main body through which the cassette enters the main body so that the pivot lever is rotated by the cassette when the cassette is mounted.

According to further examples of the present disclosure, the cassette may be mounted in or released from the main body by moving the cassette in the first direction, and the printable media may be supplied to the main body along the second direction.

According to further examples of the present disclosure, a lower part of the main body may be formed with a cassette groove in which the cassette is mounted, the cassette groove may include respective parts of two side surfaces of the main body joining at one corner, and the pivot lever may be positioned at the one corner.

According to further examples of the present disclosure, the cassette may include first and second frames, each being spaced from each other and enabling of rotating the pivot lever to the first direction when the cassette moves along the first direction. The printable media may be configured to be loaded between the first and second frames.

According to further examples of the present disclosure, one side surface of the cassette in the second direction between the first and second frames may be open, and the supporter may extend from a lower frame toward one side in the second direction more than the main body so that the cassette carries the printable media having a length longer than a length of the main body in the second direction.

According to further examples of the present disclosure, a slider being movable along the second direction may be mounted on the supporter or the supporter may be movable relatively to the cassette along the second direction.

While examples have been described, it is to be understood that the examples are not limited to the disclosed examples. On the contrary, it is intended to cover various modifications and equivalent arrangements included within the spirit and scope of the appended claims.

What is claimed is:

1. An image forming apparatus comprising:

a main body, a cassette to enter or exit the main body along a first direction to be mounted in or released from the main body, respectively, to enable supply of printable media to the main body in a mounted state, the cassette includes a supporter extendable in a second direction perpendicular to the first direction to protrude from an exterior of the main body; and a lever mounted on the main body, the lever movable in the first direction between a supporting position at which the lever supports the main body and a release position to allow the cassette to enter or exit the main body along the first direction.

2. The image forming apparatus of claim 1, wherein the supporter is to support the printable media to be supplied to the main body along the second direction.

3. The image forming apparatus of claim 1, wherein a lower part of the main body is formed with a cassette groove in which the cassette is mounted, the cassette groove includes respective parts of two side surfaces of the main body joining at one corner, and the lever is mounted at the one corner.

4. The image forming apparatus of claim 3, wherein the cassette includes:

a lower frame on which the printable media is loaded; and first and second frames, each being formed on the lower frame at a front side and a rear side of the cassette along the first direction so that the printable media is loaded between the first and second frames, and wherein the lever is pivotally mounted at the one corner to rotate by the first frame or the second frame when the cassette enters in or exits from the main body, respectively, along the first direction.

5. The image forming apparatus of claim 4, wherein one side surface of the cassette corresponding to one of the two side surfaces of the main body in the second direction between the first and second frames is open, and the supporter extends from the lower frame towards the one side surface of the cassette that is open in the second direction to protrude from the exterior of the main body.

6. The image forming apparatus of claim 5, wherein a pick-up unit is mounted at an opposite side surface to the one side surface of the cassette that is open, the pick-up unit to pick-up and supply to the main body the printable media loaded in the cassette.

7. The image forming apparatus of claim 4, wherein the first frame supports the one corner through the lever in the supporting position when the cassette is entered in the main body to the mounted state.

8. The image forming apparatus of claim 1, wherein a rail is formed on the supporter along the second direction, and a slider is movably mounted on the rail along the second direction.

9. The image forming apparatus of claim 1, wherein the supporter is movable relatively to the cassette along the second direction.

10. An image forming apparatus comprising:

a main body;

a cassette to enter or exit the main body along a first direction to be mounted in or released from the main body, respectively, to provide a supply of printable media to the main body in a mounted state, the cassette including a supporter extendable in a second direction perpendicular to the first direction to protrude to an exterior of the main body; and a lever positioned on a path through which the cassette enters or exits the main body along the first direction, the lever movable in the first direction between a supporting position at which the lever supports the main body and a release position to allow the cassette to enter or exit the main body along the first direction.

11. The image forming apparatus of claim 10, wherein supporter is to support the printable media to be supplied to the main body along the second direction so that the cassette is loadable with the printable media having a length longer than a length of the main body in the second direction.

12. The image forming apparatus of claim 10, wherein a lower part of the main body is formed with a cassette groove in which the cassette is mounted, the cassette groove includes respective parts of two side surfaces of the main body joining at one corner, and the lever is positioned at the one corner.

13. The image forming apparatus of claim 12, wherein the cassette includes first and second frames, each being spaced from each other and enabling rotation of the lever along the first direction when the cassette moves along the first direction, and wherein the printable media is to be loaded between the first and second frames.

14. The image forming apparatus of claim 13, wherein one side surface of the cassette corresponding to one of the two side surfaces of the main body in the second direction between the first and second frames is open, and the supporter extends from a lower frame towards the one side surface of the cassette that is open in the second direction to protrude to the exterior of the main body.

15. The image forming apparatus of claim 10, wherein a slider being movable along the second direction is mounted on the supporter, or the supporter is movable relative to the cassette along the second direction, to meet the printable media.

* * * * *